United States Patent [19]

Yoshiyasu et al.

[11] 4,409,444

[45] Oct. 11, 1983

[54] CIRCUIT BREAKER

[75] Inventors: Hajimu Yoshiyasu, Itami; Fumiyuki Hisatsune, Fukuyama; Shinji Yamagata, Fukuyama; Junichi Terachi, Fukuyama, all of Japan

[73] Assignee: Mitsubishi Denki Kabushiki Kaisha, Tokyo, Japan

[21] Appl. No.: 326,676

[22] Filed: Dec. 1, 1981

[30] Foreign Application Priority Data

| | | | |
|---|---|---|---|
| Dec. 9, 1980 | [JP] | Japan | 55-175987 |
| Feb. 26, 1981 | [JP] | Japan | 56-27918[U] |
| Feb. 26, 1981 | [JP] | Japan | 56-27919[U] |

[51] Int. Cl.[3] ..... H01H 33/02

[52] U.S. Cl. ..... 200/144 R; 200/149 R; 200/144 C

[58] Field of Search ..... 200/144 R, 149 R, 149 A, 200/144 C

[56] References Cited

U.S. PATENT DOCUMENTS

| | | | |
|---|---|---|---|
| 3,402,273 | 9/1968 | Davis | 200/144 R |
| 3,599,130 | 8/1971 | Murai et al. | 200/144 R |

FOREIGN PATENT DOCUMENTS

| | | | |
|---|---|---|---|
| 1765051 | 7/1971 | Fed. Rep. of Germany | 200/144 R |

*Primary Examiner*—Robert S. Macon

*Attorney, Agent, or Firm*—Wenderoth, Lind & Ponack

[57] ABSTRACT

This invention provides a novel circuit breaker which is good in terms of both its current-limiting performance and its interrupting performance. The contactors of the circuit breaker for opening and closing an electric circuit are equipped with are shields of a high resistivity material, disposed in a manner to surround the contacts thereof, and arc runways of higher conductivity than the arc shields, and of predetermined heights and directions, are further provided in a manner so as to adjoin to the contacts.

6 Claims, 22 Drawing Figures

CIRCUIT BREAKER

BACKGROUND OF THE INVENTION

This invention relates to a circuit breaker. More particularly, it is an object of the invention to provide a circuit breaker which offers enhanced current-limiting performance and interrupting performance during the tripping of the breaker.

In prior-art circuit breakers, it has been common practice to shift the arc into an arc extinguisher or to raise the separating speed of the contacts in order to quickly extinguish an electric arc struck across the gap between a pair of contacts during the interrupting operation. Such circuit breakers, however, have has the disadvantage that the foot of the arc struck across the gap between the contacts expands to fall onto the contactor conductors on which the contacts are mounted, with the result that the arc voltage, which relates to the extinction of the arc, lowers.

SUMMARY OF THE INVENTION

This invention consists in that the foot of an electric arc struck across a gap between contacts has its size and position restrained from expansion, thereby to attain a high arc voltage and enhance the current-limiting performance of the circuit breaker and also to smooth the run of the arc and enhance the interrupting performance of the circuit breaker. More specifically, this invention pertains to a circuit breaker in which the contactors of the circuit breaker for making and breaking an electric circuit are provided with arc shields of a high resistivity material in a manner so as to surround the contacts thereof, and are formed with arc runways of a higher conductivity than the arc shields and of a predetermined height and directions provided in a manner so as to adjoin to the contacts.

BRIEF DESCRIPTION OF THE DRAWINGS

FIG. 1(*b*) is a sectional side view of the circuit breaker of FIG. 1(*a*) taken along the dot-and-dash line b—b;

FIG. 3(*b*) is a plan view of the stationary contactor of FIG. 3(*a*);

FIG. 3(*c*) is a sectional side view of the stationary contactor taken along the line c—c in FIG. 3(*b*);

FIG. 3(*d*) is a sectional side view of the stationary contactor taken along the line d—d in FIG. 3(*b*);

FIG. 9(*b*) is a sectional side view taken along the line b—b in FIG. 9(*a*)

In the drawings, like symbols denote like or corresponding parts.

DESCRIPTION OF THE PREFERRED EMBODIMENTS

Figure 1A:
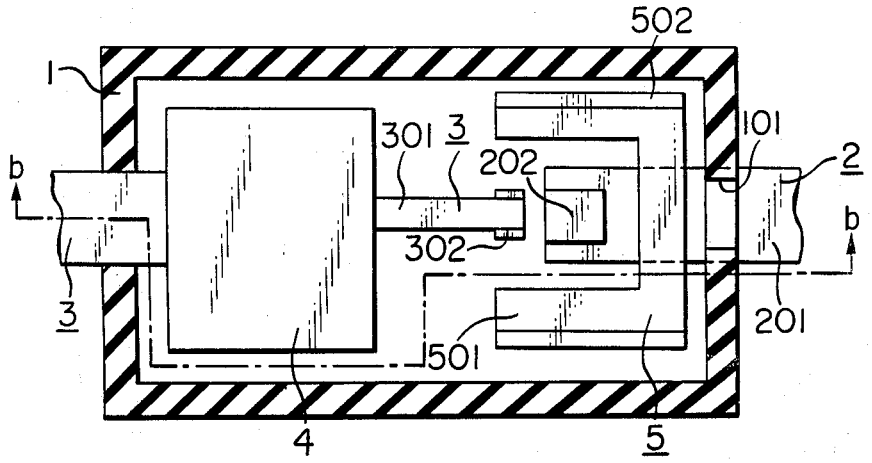
FIG. 1(*a*) is a sectional plan view of a conventional circuit breaker to which this invention is applicable.

A conventional circuit breaker to which this invention is applicable will be described with reference to FIGS. 1(*a*) and 1(*b*).

An enclosure 1 is made of an insulating material, forming the housing for a switching device, and is provided with an exhaust port 101. A stationary contactor 2 housed in the enclosure 1 comprises a stationary rigid conductor 201 which is rigidly fixed to the enclosure 1, and a stationary-side contact 202 which is mounted on one end of the stationary rigid conductor 201. A movable contactor 3 which is adapted to engage the stationary contactor 2 comprises a movable rigid conductor 301 which makes or breaks contact with the stationary rigid conductor 201, and a movable-side contact 302 which is mounted on one end of the movable rigid conductor 301 in opposition to the stationary-side contact 202. An operating mechanism 4 operates to move the movable contactor 3 in or out of contact with the stationary contactor 2. An arc-extinguishing plate assembly 5 functions to extinguish an electric arc A struck upon the separation of the movable-side contact 302 from the stationary-side contact 202, and it is so constructed that a plurality of arc-extinguishing plates 501 are supported by frame plates 502. The arc-extinguishing plates 501 are usually formed of a magnetic material such as iron.

Figure 1B:
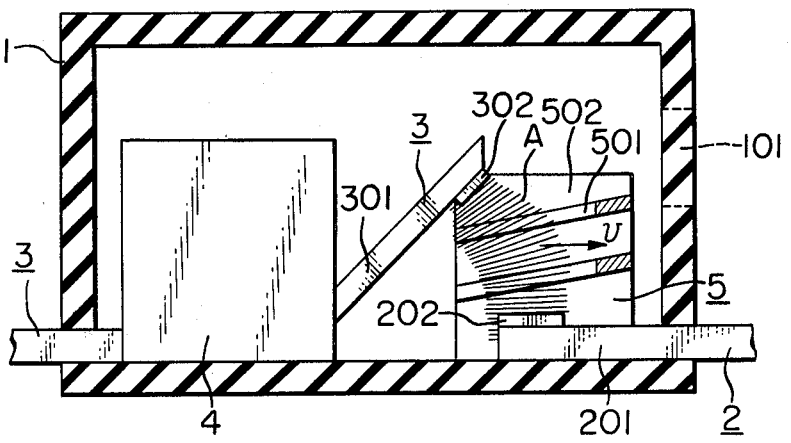

Although, for the sake of simplicity of illustration, the arc-extinguishing plates 501 are illustrated as numbering two in FIG. 1(*b*), it is to be understood that actually the number of arc-extinguishing plates 501 in the arc-extinguishing plate assembly 5 may number as many as, for example, ten.

The operating mechanism 4 and the arc-extinguishing plate assembly 5 are well known in the art, and are described, for example, in U.S. Pat. No. 3,599,130, "Circuit Interruptor", issued to W. Murai et al, Aug. 10, 1971. As apparent from the named patent, the operating mechanism includes a reset mechanism.

Assuming now that the movable-side contact 302 and the stationary-side contact 202 are closed, current flows from a power supply side onto a load side along a path from the stationary rigid conductor 201 to the stationary-side contact 202 to the movable-side contact 302 to the movable rigid conductor 301. When, in this state, a high current such as a short-circuit current flows through the circuit, the operating mechanism 4 operates to separate the movable-side contact 302 from the stationary-side contact 202. At this time, an arc A appears across the gap between the stationary-side contact 202 and the movable-side contact 302, and an arc voltage develops thereacross. The arc voltage rises as the distance of separation of the movable-side contact 302 from the stationary-side contact 202 increases. In addition, since the arc-extinguishing plates 501 are made of a magnetic material and having a reluctivity much lower than that of the surrounding space, a magnetic flux induced by the current of the arc A is attracted in the direction v (FIG. 1(*b*)) of the arc-extinguishing plates 501. Accordingly, the arc A is drawn toward the arc-extinguishing plates 5 and is stretched, whereby the arc voltage rises even further.

As a means for driving the arc in the direction v or toward the arc-extinguishing plate assembly 5, a method utilizing an air current is also well known, in addition to the above method utilizing a magnetic field. More specifically, the arc is driven by the air current which is created when the air in the enclosure 1 is raised in temperature and pressure by the energy of the arc A and is discharged through the exhaust port 101. As a means for driving the arc utilizing a magnetic field, in addition to the above described method employing arc-extinguishing plates 501, also well known are a method employing a blowout coil, a blowout magnet, or a permanent magnet; a method utilizing a parallel current which flows in the reverse direction across the stationary rigid conductor 201 and the movable rigid conductor 301, and so on.

In the manner described above, the arc current reaches the current zero point to extinguish the arc A, so that the interruption is completed. Where the power supply is a D.C. power supply, an arc voltage greater than the supply voltage is generated, whereby a current limiting action is effected and the current zero point is forcibly established. With a D.C. power supply, accordingly, a phenomenon similar to that in the case of the foregoing A.C. current zero point occurs. During the interrupting operation thus far described, large quantities of energy are generated across the gap between the movable-side contact 302 and the stationary-side contact 202 in a short space of time of the order of several milliseconds, by the arc A. In consequence, the temperature of the gas within the enclosure 1 rises abruptly, as does the pressure thereof, and the high temperature and pressure gas is emitted into the atmosphere through the exhaust port 101.

The circuit breaker performs the interrupting operation as described above. In this case, the operations of the stationary-side contact 202 and the movable-side contact 302 can be analyzed as follows. In general, the arc resistance R (Ω) is given by the following expression:

$$R=\rho l/S$$

where $\rho$: arc resistivity (Ω·cm)

l: arc length (cm)

S: arc sectional area ($cm^2$)

In general, in a short arc A with a high current of at least several kA and an arc length l of at most 50 mm, the arc space is occupied by particles of metal from the rigid conductors on which the arc has its foot. Moreover, the emission of metal particles from the rigid conductors occurs orthogonally to the rigid conductor surfaces. At the time of the emission, the metal particles have a temperature close to the boiling point of the metal used in the rigid conductors. When injected into the arc space, the metal particles possess a conductivity due to the electrical energy of the arc and they are also further raised in temperature by the arc, and flow away from the rigid conductors at high speed while expanding in a direction conforming with the pressure distribution in the arc space. The arc resistivity $\rho$ and the arc sectional area S in the arc space are determined by the quantity of metal particles produced and the direction of emission thereof. Accordingly, the arc voltage is determined by the behaviour of such metal particles.

Figure 2:
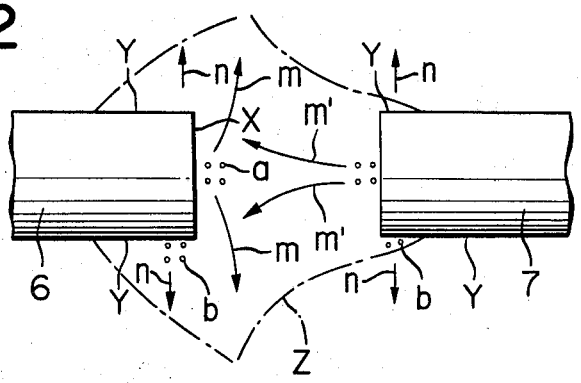
FIG. 2 is a model diagram showing the behaviour of metal particles emitted from the conductors of switching contactors in the circuit breaker of FIGS. 1(*a*) and 1(*b*)
Figure 3A:
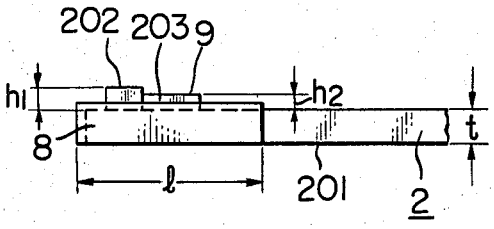
FIG. 3(*a*) is a side view showing an embodiment of a stationary contactor for use in a circuit breaker according to this invention.
Figure 3B:
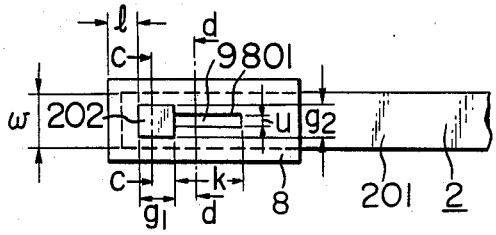
Figure 3C:
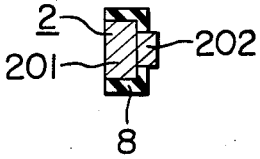
Figure 3D:
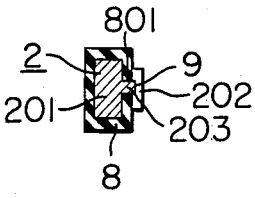
Figure 4A:
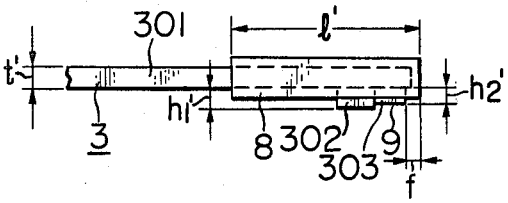
FIGS. 4(*a*), 4(*b*), 4(*c*) and 4(*d*) are a side view, a plan view, a sectional side view taken along the line c—c, and a sectional side view taken along the line d—d respectively, similar to FIGS. 3(*a*), 3(*b*), 3(*c*) and 3(*d*), respectively, but illustrating a movable contactor.
Figure 4B:
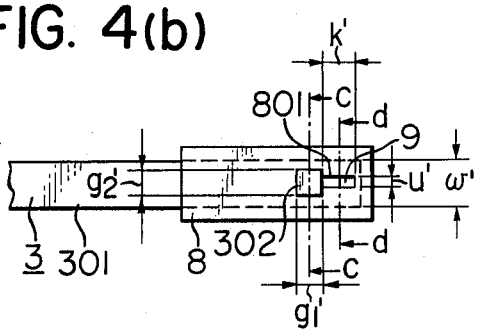
Figure 4C:
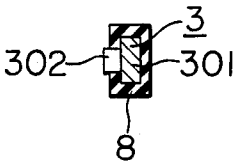
Figure 4D:
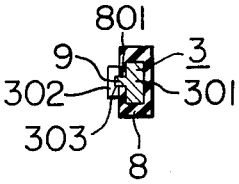

FIG. 2 is a model diagram to illustrate the behaviour of the metal particles. Referring to the figure, a pair of rigid conductors 6 and 7 are ordinary conductors in the form of mutually opposed metallic cylinders. The rigid conductor 6 is an anode, while the rigid conductor 7 is a cathode. The surface X of the respective rigid conductors 6 and 7 are opposing surfaces which become contact surfaces when the rigid conductors 6 and 7 come into contact, and the surfaces Y of the respective rigid conductors 6 and 7 are the surfaces of the rigid conductors other than the surfaces X, the opposing contact surfaces. The description of the behaviour of the metal particles to be given below also applies similarly to a case where the surfaces X are formed from the contact member themselves. A contour Z indicated by a dot-and-dash line in the figure is the envelope of the arc A struck across the gap between the rigid conductors 6 and 7. Further, metal particles a and metal particles b are typically representative of the metal particles which are respectively emitted from the surfaces X and Y of the rigid conductors 6 and 7 by vaporization etc. The directions of emission of the metal particles a and b are the directions of the flow lines indicated by arrows m, m' and n, n', respectively.

Such metal particles a and b emitted from the rigid conductors 6 and 7 have their temperature raised by the energy of the arc space from approximately 3,000° C., the boiling point of the metal of the rigid conductors, to a temperature at which the metal particles bear a conductivity, i.e., at least 8,000° C., or to the even higher temperature of approximately 20,000° C. As the temperature rises, the metal particles take energy out of the arc space and thus lower the temperature of the arc space, resulting in increased arc resistance R. The quantity of energy taken from the arc space by the metal particles a and b increases with the rise in the temperature of the metal particles. In turn, the rise in the temperature is determined by the positions and emission paths of the metal particles a and b emitted from the rigid conductors 6 and 7. Further, the paths of the metal particles a and b emitted from the rigid conductors 6 and 7 are determined by the pressure distribution in the arc space. The pressure in the arc space is determined by the mutual relationship between the pinch force of the current itself and the thermal expansion of the metal particles a and b. The pinch force is a quantity which is substantially determined by the current density. In other words, it is determined by the size of the foot of the arc A on the rigid conductors 6 and 7. In general, the metal particles a and b may be considered to fly in the space determined by the pinch force while thermally expanding. It is also known that, in a case where the size of the foot of the arc A on the rigid conductors 6 and 7 is not limited, the metal particles a blow unidirectionally from one rigid conductor 7 to the other rigid conductor 6 in the form of vapor jet. When, in this manner, the metal particles a blow unidirectionally from one rigid conductor 7 toward the other rigid conductor 6, the metal particles a to be injected into the positive column of the arc A are supplied substantially from only the rigid conductor 7 on one side. FIG. 2 illustrates by way of example a case where the metal particles blow strongly from the cathode to the anode, but they may also blow in the opposite direction.

The above phenomenon will now be described in greater detail. In FIG. 2, it is supposed that the blowing, for whatever reason, is unidirectional from the rigid conductor 7 toward the rigid conductor 6. The metal particles a starting from the surfaces X being the opposing contact surfaces of the rigid conductors 6 and 7 tend to fly orthogonally to the rigid conductor surfaces, i.e. toward the positive column of the arc. At this time, a metal particle a which begins its flight from the contact surface X of one rigid conductor 7 is injected into the positive column by pressure caused by the pinch force. In contrast, a metal particle a which begins its flight from the contact surface X of the other rigid conductor 6 is pushed by the particle stream in the positive column and is ejected outside the contact surface X, immediately being forced out of the system without entering the positive column. In this manner, the flights of the metal particle a emitted from the rigid conductor 6 and of the metal particle a emitted from the rigid conductor 7 are different as indicated by the flow lines of the arrows m and m' in FIG. 2. As stated before, this is based on the difference between the pressures caused by the pinch forces at the rigid conductor surfaces. Thus, the unidirectional blowing from the rigid conductor 7 heats the rigid conductor 6 on the blown side and expands the foot (anode spot in some cases, and cathode spot in others) of the arc on the surface of the rigid conductor 6 from the front surface X thereof to the other surface thereof. In consequence, the current density on the surface of the rigid conductor 6 lowers, as does the pressure of the arc. Accordingly, the unidirectional blowing from the rigid conductor 7 is increasingly intensified. The discrepancy in the flight paths of the metal particles a emitted from the respective rigid conductors 6 and 7 as has thus occurred results in a discrepancy in the quantities of energy that the particles of both the conductors take from the arc space. More specifically, a metal particale a flown from the contact surface X of the rigid conductor 7 is able to absorb substantial energy from the positive column, whereas a metal particle a flown from the contact surface X of the rigid conductor 6 is not, and so it is ejected out the the system without effectively cooling the arc A. On the other hand, metal particles b emitted from the surfaces Y of the respective rigid conductors 6 and 7 spread transversely as indicated by the flow lines of the arrows n and n' in the figure. Therefore, they do not deprive the arc A of substantial heat. Moreover, they increase the arc sectional area S, resulting in lowered arc resistance R of the arc A.

In this manner, in the instance of blowing from one rigid conductor 7, the efficiency of the cooling of the positive column by the metal particles a of the other rigid conductor 6 worsens. In addition, the metal particles b appearing from the surfaces Y of both the rigid conductors 6 and 7, being those surface other than the opposings contact surfaces, do not contribute to the cooling of the positive column at all and may even lower the arc resistance R by increasing the arc sectional area S. Accordingly, the presence of the unidirectional blowing of the metal particles from one rigid conductor to the other is impedimental to raising the arc voltage and renders it impossible to enhance the current-limiting performance during tripping.

There are, however, several disadvantages, in that, in general, the stationary contactor and the movable contactor used in conventional circuit breakers have large opposing surface areas, similar to the conductors of the model of FIG. 2, making it impossible to limit the size of the foot of the struck arc. Moreover, the contactors have exposed surfaces such as peripheral surfaces in addition to the opposing surfaces, so that, as explained with reference to FIG. 2, the position and size of the foot (anode spot or cathode spot) of the arc appearing on the surfaces of the two conductors cannot be limited. Furthermore, the unidirectional blowing of the metal particles a from one contactor to the other occurs, with the result that the arc sectional area increases as explained with reference to FIG. 2, such that the current-limiting performance during tripping cannot be enhanced, as stated above.

As apparent from the foregoing, in order to enhace the current-limiting performance of a circuit breaker, the arc voltage needs to be raised, and to this end, the metal particles appearing in the foot of the arc need to be effectively injected into the positive column from both electrodes. The force which injects the metal particles into the positive column is the pressure based on the pinch force arising in the foot of the arc, and the pinch force changes greatly in accordance with the size of the foot of the arc on the contactors, or with the current density. It is accordingly possible to control the pinch force. In conventional contactors, the area of the surfaces X of the conductors is large, which effectively prevents a limitation of the size of the foot of the arc. When the opposing contact surfaces X of both the contactors are made sufficiently small, the density of current on the contact surfaces X rises substantially, increasing the pinch force. Accordingly, metal particles are injected from both sides into the positive column, unlike the prior-art circuit breaker, so that the arc voltage becomes higher than in the prior art. With this measure alone, however, the spread of the foot of the arc to parts other than the contact surfaces X or to the surfaces Y cannot be restrained, and the current density on the contact surfaces X decreases by a component corresponding to the spread of the foot of the arc to the surfaces Y, so that the metal particle injection pressure lowers. With the contactors of the prior art, accordingly, the cooling effect on the positive column by the injection of metal particles is not the maximum possible.

Further, in the contactors of the prior art, the spread of the foot of the arc to the surface Y leads to the disadvantage that the foot of the arc is liable to spread directly to the interfacing point between the contact and the conductor which is often set on the surface Y and a joint member of a low fusing point may be melted by the heat of the arc, making the contact liable to fall off.

It is an object of this invention to provide a circuit breaker which provides good current-limiting performance in the interruption of excess currents such as accompany electric faults, and which also provides good performance in the interruption of ordinary overcurrents, such as occur in the case of an overload. With a circuit breaker according to this invention, these and other objects can be achieved by providing arc shields of a high resistivity material, on the rigid conductors of the contactors, in a manner to surround the contacts so as to leave contact surfaces of a predetermined limited area, and that arc runways having predetermined heights and directions are formed in adjacency to the contacts. As the high resistivity material for the arc shields organic or inorganic insulators, as well as high resistivity alloys or metals such as copper-nickel, copper-manganese, manganese, iron-carbon, iron-nickel and iron-chromium may be used. It is also possible to use iron of which the resistivity increases abruptly with temperature.

Hereinbelow, an embodiment of this invention will be described with reference to FIGS. 3(*a*)–3(*d*), FIGS. 4(*a*)–4(*d*), FIG. 5(*a*) and FIG. 6.

Figure 6:
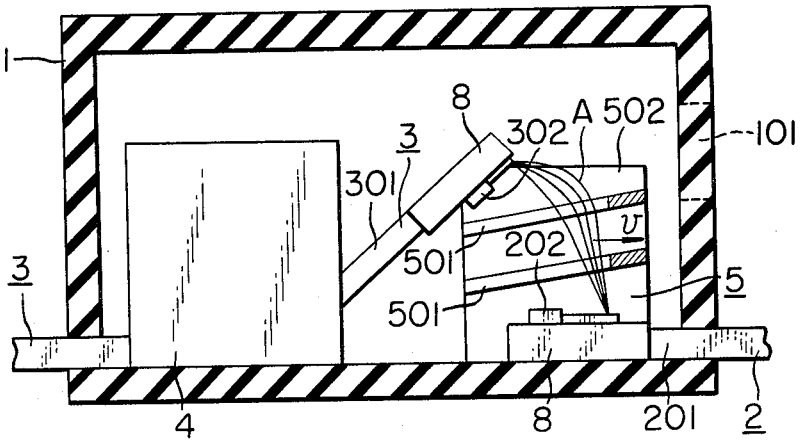
FIG. 6 is a sectional side view illustrating the operation of a circuit breaker according to this invention equipped with the stationary contactor of FIGS. 3(*a*)-3(*d*) and the movable contactor of FIGS. 4(*a*)-4(*d*)

FIGS. 3(*a*)–3(*d*) and FIGS. 4(*a*)–4(*d*) illustrate the respective constructions of a stationary contactor 2 and a movable contactor 3 in a circuit breaker according to this invention, as shown in FIG. 6. The dimensions of the contactors to be mentioned hereinbelow are typical values relating to a circuit breaker in which the rated current is 100 A.

As illustrated in detail in FIGS. 3(*a*)–3(*d*), the stationary contactor 2 is constructed of a stationary rigid conductor 201 which has a protrusion 203, an arc shield 8 which has a slit 801, and a stationary-size contact 202. The bar-shaped stationary rigid conductor 201 is made of an electrical conductor, for example, copper. It is approximately 8 mm in width (w) and 4 mm in thickness (t), and the protrusion 203 located on the upper surface is 2 mm in width (u), 2.5 mm in height (h2) and 10 mm in length (k). The stationary-side contact 202 is in the shape of a square pillar of a height (h1) of 3 mm and a square base of sides (g1) and (g2) each 4.5 mm in length. This stationary-side contact 202 has its lower surface secured to the upper surface of the stationary rigid conductor 201 in such a manner that one side surface of the stationary-side contact 202 remote from the fore end of the stationary contactor 2 adjoins to one end of the protrusion 203. The stationary-side contact 202 is made of a suitable contact material, such as, for example, a silver alloy containing tungsten carbide (WC) or iridium. The arc shield 8 is made of a material of high electrical resistivity, such as an electrical insulator such as phenol resin or a ceramic. The arc shield 8 forms a layer of a thickness of 1.5 mm covering the side surfaces and upper surface of the stationary rigid conductor 201 in the immediate vicinity of the stationary-side contact 202, excluding the space occupied by the protrusion 203. The length (l) of the arc shield 8 is substantially 25 mm. The protrusion 203 is arranged to protrude 1 mm above the surface of the arc shield 8 through the slit 801 provided in the arc shield 8 in congruity with the protrusion. The upper surface of the protrusion 203 forms an arc runway 9. In addition to the materials such as the aforementioned phenol resin of a ceramic, the arc shield 8 may eaually be constructed of a shynthetic resin such as a polyester resin, drill resin, PPS (polyphenol sulfite) resin, PBT (polybutylene terephthalate) resin, polyhydroxybenzylene resin and C-FRP (carbon fiber reinforced plastic) resin, a boron nitride, or a vulcanized fiber, etc. For a circuit breaker of low rated current, even paper may be used. The lower surface of the stationary conductor 201, however is secured to the enclosure 1, and so it is not covered by the arc shield 8. The stationary-side contact 202 is so situated that the distance (e) between the fore-end of the stationary contactor 2 and one side surface of the stationary-side contact 202 on the fore-end side of the stationary contactor 2 is 3 mm.

Referring now to FIGS. 4(*a*)–4(*d*), the movable contactor 3 of the circuit breaker shown in FIG. 6 will be described. The movable contactor 3 is constructed of a movable rigid conductor 301, a movable-side contact 302 and an arc shield 8. The movable rigid conductor 301 which may be made of the same material as that of the stationary rigid conductor 201 is formed in the shape of a bar with a width (w′) of 8 mm and a thickness (t′) of 3.2 mm. On the lower surface thereof is provided a protrusion 303 which is 2 mm in width (u′) and 6 mm in length (k′). A movable-side contact 302 is also secured to the lower surface of the movable rigid conductor 301 in a manner to adjoin to one end of the protrusion 303 remote from the fore-end of the movable contactor 3. The movable-side contact 302 may be made of the same material as that of the stationary-side contact 202, and ordinarily has the same shape and dimensions as the latter. Accordingly, g1′=g2′=4.5 mm and h1′=3 mm. The arc shield 8 of the movable contactor 3 may also be made of the same material as the arc shield 8 employed on the stationary contactor 2. Also similarly, the arc shield 8 on the movable contactor 3 forms a layer of a thickness of 1.5 mm, which covers the surface of the movable rigid conductor 301 in the immediate vicinity of the movable-side contact 302, excluding the lower surface and side surfaces of the protrusion 303. The height (h2′) of the protrusion 303 is 2.5 mm, the height (h1′) of the movable-side contact 302 is 3 mm, and the thickness of the arc shield 8 is 1.5 mm. Therefore, the protrusion 303 and the movable-side contact 302 protrude 1 mm and 1.5 mm respectively, below the lower surface of the arc shield 8. The lower surface of the protrusion 303 protruding beyond a slit 801 provided in the arc shield 8 forms an arc runway 9. The distance (f) between the fore-end of the movable contactor 3 and one end of the protrusion 303 close to the fore-end of the movable contactor 3, is 2 mm.

Now, the arcing across the contactors 2 and 3 of the circuit breaker shown in FIG. 6 will be described with reference to FIG. 5(*a*) which illustrates as a model an electric arc struck when the stationary contactor 2 and the movable contactor 3 are mutually disengaged.

Figure 5A:
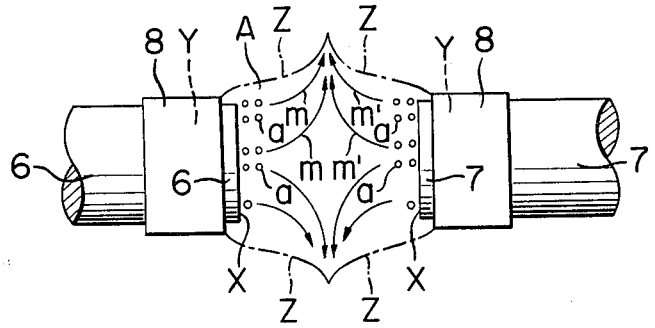
FIGS. 5(*a*) and 5(*b*) are model diagrams each illustrating the behaviour of metal particles emitted from the conductors of the switching contactors of the circuit breaker according to this invention.
Figure 5B:
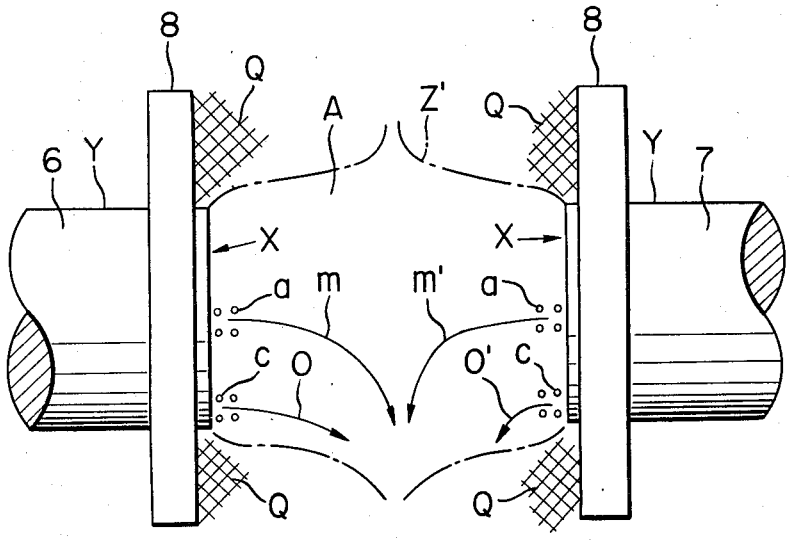

In FIG. 5(*a*), a rigid conductor 6 in the shape of a metallic circular cylinder corresponds to the stationary conductor 201 shown in FIGS. 1(*a*) and 1(*b*), while a rigid conductor 7 in the shape of a metallic circular cylinder corresponds to the movable conductor 301. The respective rigid conductors 6 and 7 are provided with covering arc shileds 8 of a high resistivity material except in the area of the surface X, the opposing contact surfaces and the immediate vicinities thereof. That is, the surfaces Y being the peripheral surfaces of the conductors other than the opposing contact surfaces X are substantially covered by the arc shields 8. Accordingly, the metal particles b which are emitted from the surfaces Y in the prior art as shown in FIG. 2 are not emitted. Even when the surfaces X are constructed from the contact members, the metal particle behaviour is substantially similar to that to be described below. The contour Z of the arc, metal particles a emitted from the conductor surfaces and arrows m and m′ indicative of the flight of these metal particles are identical to those explained with reference to FIG. 2.

Since, in the present case, the surfaces Y are covered by the arc shields 8, no metal particles are emitted therefrom, and so the metal particles emitted are only those metal particles a that come from the surfaces X of the rigid conductors 6 and 7.

Further, since the size of the foot (anode spot or cathode spot) of the arc on the rigid conductors 6 and 7 is limited, it does not spread. Accordingly, abrupt lowering of the pressure on the rigid conductor surfaces attribut able to the spreading of the foot of the arc does not occur, nor does the attendant phenomenon in which metal particles from the surfaces Y are ejected out of the system at low temperature, so that the pressure on the rigid conductor surfaces corresponding to the limited size is reliably obtained. Thus, the metal particles a from the opposing surfaces X of the conductors 6 and 7 are reliably injected into the positive column portion, and efficient cooling is achieved.

Therefore, the arc sectional area S is substantially contracted when compared with the rigid conductors in the prior art illustrated in FIG. 2. Moreover, with an equal current, the current density is higher than in the prior-art device described with reference to FIG. 2, so that the quantity of metal particles a emitted from the surfaces X increases to raise the quantity of energy which the metal particles take from the arc space. As a result, the arc space is more effectively cooled, and the arc resistivity $\rho$ of the arc space rises due to the temperature fall.

As thus far described, compared with the prior art illustrated in FIG. 2, the arc sectional area S is significantly contracted and the arc resistivity $\rho$ is raised, so the arc resistance R also increases. Accordingly, for an identical current value, the arc voltage is much greater, enhancing the current-limiting performance.

Now, as illustrated in FIGS. 3(*a*)—3(*d*) and FIGS. 4(*a*)–4(*d*), the contactors 2 and 3 disposed in the circuit breaker according to this invention are formed with arc runways 9 of predetermined directions and heights provided in a manner so as to adjoin to the contacts 202 and 302, together with the arc shields 8. The arc runway 9 is made high in conductivity than the arc shield 8. As will be discussed later, running of the arc is facilitated if the arc struck across the gap between the contacts when interrupting an overload current of about 6 times the circuit's rated current, is guided towards the arc-extinguishing plates (501 in FIG. 6).

More specifically, with a rated current of the electric circuit of 100 A, an excess current amounting to, e.g., 5,000 A or more might flow in the case of e.g., a short-circuit fault in the electric circuit in which the circuit breaker is installed, while an overcurrent of about 600 A or below might, flow in the case of an overload of the electric circuit. Regarding this excess current, in order to prevent any damage to the electrical equipment connected in the electric circuit, it is necessary that the arc voltage be raised quickly to satisfactorily execute the current-limiting operation as described above in detail. Accordingly, steps must be taken to prevent the foot of the arc from spreading. On the other hand, with an overcurrent of the magnitude that flows at the time of an overload, means must be provided to suitably extinguish the arc. In view of such points, the arc runway is formed as an elongated member of a predetermined height, to prevent the arc occurring at the moment of excess current from spreading its foot, and also to facilitate the arc's run when the current value is of the order of an overcurrent.

FIG. 6 is a sectional side view of a circuit breaker equipped with the stationary contactor 2 shown in FIGS. 3(*a*)–3(*d*) and the movable contactor 3 shown in FIGS. 4(*a*)–4(*d*). The parts of this circuit breaker other than the contactors 2 and 3 are of similar construction to the corresponding parts of the prior art circuit breaker shown in FIGS. 1(*a*) and 1(*b*). As illustrated in FIG. 6, the electric arc A struck across the gap between the contacts 202 and 302 of the respective contactors 2 and 3 is caused to travel on the arc runways 9 in the direction v of the arc-extinguishing plate assembly 5 by the same arc driving means as in the circuit breaker of FIGS. 1(*a*) and 1(*b*). The arc A is extinguished by having its length substantially stretched, and large proportions of its heat absorbed by means of the arc-extinguishing plate 501. Since, in this case, the arc runways 9 protrude beyond the surfaces of the arc shields 8, the arc runs smoothly in the direction v of the arc-extinguishing plate assembly 5, and wear of the arc shields 8 as well as of the contacts 202 and 302 is reduced. The running of the arc A described above permits rapid extinction of the arc, which aids the rapid interruption of overcurrents, and accordingly speeds the recovery of electrical isolation between the contacts 202 and 302.

Figure 7A:
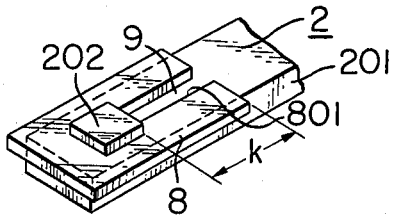
FIGS. 7(*a*) and 7(*b*) are perspective views of a stationary contactor and a movable contactor, respectively, showing an embodiment in which the arc shields have a plate-like configuration and in which the arc runways are formed so as to be protruding in one contactor and recessed in the other contactor.
Figure 7B:
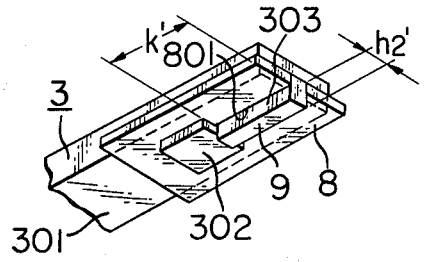

As described hereinabove, this invention provides a circuit breaker which has excellent current-limiting and interrupting performance. Although, in the embodiment shown in FIGS. 3(*a*)–3(*d*) and FIGS. 4(*a*)–4(*d*), one arc runway 9 is formed in each of the contactors 2 and 3, substantially the same effect as those above described will be achieved with a plurality of runways formed in each contactor, the plurality of runways numbering as many as may be needed. In addition, the arc shields 8 may equally well be constructed in the form of flat plates as illustrated in the embodiments of FIG. 7(*a*) and subsequent figures. This measure is effective in suppressing the spread of the foot of the arc and in confiring the size of the foot of the arc.

FIGS. 5(*b*) is a model diagram for explaining the effects of the flat plate arc shield. Referring to the figure, a pair of rigid conductors 6 and 7 have substantially the same shape as those in FIG. 2. Flat plate arc shields 8 are respectively mounted on the rigid conductors 6 and 7 so as to leave protruding surfaces X, the opposing contact surfaces of the rigid conductors 6 and 7, which oppose an electric arc A. Of course, the description of the metal particle behavior to be given below is similarly applicable even when the surfaces X are formed from the contact members themselves. Pressure values in the spaces Q cannot exceed the pressure value of the space of the arc A itself. However, much higher values are exhibited, at least in comparison with the values attained without the arc shields 8. Accordingly, the peripheral spaces Q, which have the relatively high pressures caused by the arc shields 8, generate forces that suppress the spread of the space of the arc A and confine the arc A to a small area. This results in fining and confining into the arc space of the flow lines m, m′, o and o′ of metal particles a and c emitted from the surfaces X being the opposing contact surfaces. Therefore, the metal particles a and c having been emitted from the surfaces X are effectively injected into the arc space. As a result, large quantities of metal particles a and c are effectively injected and take large quantities of energy from the arc space, thus cooling the arc space. Accordingly, the resistivity $\rho$ or the arc resistance R is significantly raised, as is the arc voltage.

Further, when the arc shields 8 are disposed near and around the contact surfaces of the stationary-side contact and the movable-side contact, namely, the surfaces X being the opposing contact surfaces shown in FIG. 5(*b*), the arc A is prevented from moving to the surfaces Y being the other surfaces of the conductor and also the size of the foot of the arc A is limited. Thus, the emission of the metal particles a and c is concentrated on the surfaces X, and the arc sectional area S is contracted, so that the effective injection of metal particles a and c into the arc space is further promoted. Accordingly, the cooling of the arc space, the rise of the arc resistivity $\rho$ and the rise of the arc resistance R are further improved, and the arc voltage can be further raised.

FIGS. 7(*a*) and 7(*b*) are perspective views of a stationary contactor 2 and a movable contactor 3 respectively provided with flat plate arc shields 8 having the effects as described above.

In this embodiment, the stationary contactor 2 of FIG. 7(*a*) is constructed of a stationary rigid conductor 201, a stationary-side contact 202 and an arc shield 8 which may respectively be made of the same materials as those of the corresponding parts of the stationary contactor 2 illustrated in FIGS. 3(*a*)–3(*d*). The stationary rigid conductor 201 and the stationary-side contact 202 also have substantially the same dimensions and positional relationships as those of the stationary rigid conductor 201 and the stationary-side contact 202 in FIGS. 3(*a*)–3(*d*), respectively, but the stationary rigid conductor 201 of the present embodiment does not have any protrusions therefrom. The arc shield 8 is a flat or plate-like member, 25 mm long, 11 mm wide and 1.5 mm thick, and is formed with a slit 801 which is 2 mm wise. The slit 801 is open at the end thereof remote from the stationary-side contact 202, and its length (k) is 17.5 mm. The upper surface of the stationary rigid conductor 201 exposed by the slit 801 forms an arc runway 9. Those dimensions etc. of the stationary contactor of FIG. 7(*a*) not described above are substantially identical to those of the stationary contactor of FIGS. 3(*a*)–3(*d*).

The movable contactor 3 of FIG. 7(*b*) includes a movable rigid conductor 301, a movable-side contact 302 and an arc shield 8, each of which may respectively be made of the same materials as those of the corresponding parts of the stationary contactor 2 of FIG. 7(*a*). Further, it includes a protrusion 303 made of an electrically conductive material. The protrusion 303 is disposed so as to adjoin to the movable contact 302, and forms a rectangular parallelepiped which is 2 mm in width, 10 mm in length (k′) and 4 mm in height (h2′). This protrusion protrudes beyond a slit 801 which is provided in the arc shield 8 in congruity therewith. The lower surface of the protrusion 303 forms an arc runway 9. Those dimensions etc. of the movable contactor of FIG. 7(*b*) not described above are substantially identical to those of the movable contactor of FIGS. 4(*a*)–4(*d*).

In this manner, the arc runway 9 of the movalbe contactor 3 in FIG. 7(*b*) protrudes beyond the surface of the movable-side contact 302 and is closer to the stationary-side contact 202 than the movable-side contact 302 itself. Therefore, the arc struck across the gap between the contacts 202 and 302 is readily drawn onto the arc runway 9, and the reduction of burnout of the movable-side contact 302, etc. is enhanced.

Figure 8A:
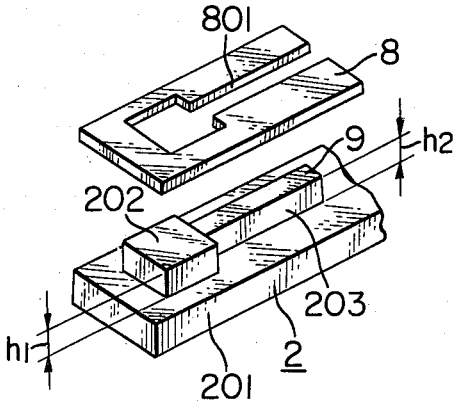
FIGS. 8(*a*) and 8(*b*) are perspective views of a stationary contactor and a movable contactor, respectively, showing an embodiment in which arc runways protrude so that they are level with the contacts.
Figure 8B:
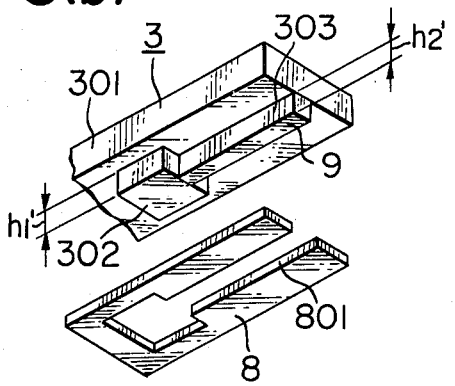

FIGS. 8(*a*) and 8(*b*) show another embodiment. In this embodiment, adjoining to contacts 202 and 302 disposed on the rigid conductors 201 and 301 of a stationary contactor 2 and a movable contactor 3, are provided protrusions 203 and 303 which have heights (h2) and (h2′) respectively equal to the heights (h1) and (h1′) of the contacts 202 and 302. The upper surface of the protrusion 203 and the lower surface of the protrusion 303 are used as arc runways 9. Arc shields 8 are provided with slits 801 in congruity with the contacts and the arc runways as shown in the figures. Since the arc runways 9 in this embodiment are substantially level with the contacts 202 and 302 ($h1=h1'=h2=h2'$), they aid the smooth running of the arc struck across the gap between the contacts.

Figure 9A:
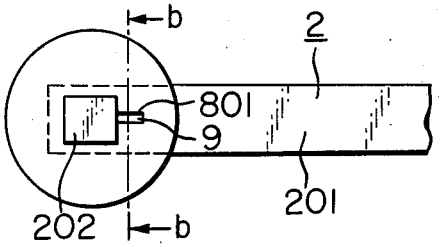
FIG. 9(*a*) is a plan view of a stationary contactor showing another embodiment of the arc shield.
Figure 9B:
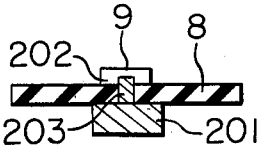

FIG. 9(*a*) is a plan view of a stationary contactor 2 showing another embodiment in which an arc shield 8 is formed as a disc, while FIG. 9(*b*) is a side sectional view taken along line b—b in FIG. 9(*a*). In this embodiment, the arc runway 9 is similar to those described hereinabove, but the arc shield 8 has a plate-like flat circular surface. Accordingly, the action of fining the arc struck across the gap between the contacts as explained with reference to FIG. 5(*b*) proceeds uniformly on the outer periphery of the arc, to raise the potential gradient of the positive column and to raise the arc voltage. Thus, the current-limiting performance of the circuit breaker is enhanced.

Figure 10A:
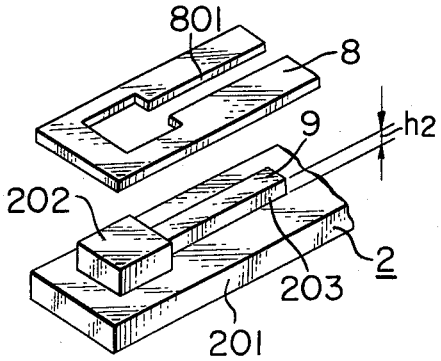
FIGS. 10(*a*) and 10(*b*) are perspective views of a stationary contactor and a movable contactor, respectively, showing an embodiment in which the arc runways are constructed of a specific material.
Figure 10B:
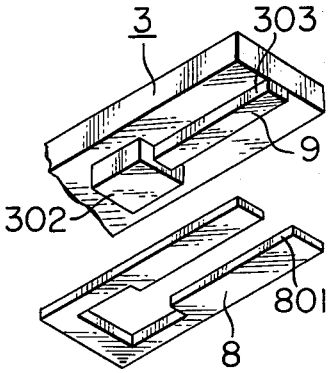

FIGS. 10(*a*) and 10(*b*) show still another embodiment. Protrusions 203 and 303 which are, for examle, each 2 mm in height (h2 and h2′) and which exhibit a high thermall conductivity are mounted on the respective rigid conductors 201 and 301 of stationary and movable contactors 2 and 3 in congruity with the slits 801 of the arc shields 8. Not only does this facilitate the running of the arc as described above, but it also aids the efficient radiation of the considerable heat that builds up in the contacts 202 and 302 when they are heated by the arc struck across the gap between these contacts. Where the members 203 and 303 are made of a material with a high-melting point, higher than that of the conductors of the contactors, i.e. a material such as tungsten, a copper-tungsten alloy, a silver-tungsten alloy, nichrome or kanthal, wearing a way of the members 203 and 303 by running of the arc is minimal, even when the circuit breaker is used frequently.

Further, where a magnetic material such as iron and nickel adapted to deionize an arc plasma is used as the material for the protrusions 203 and 303, the extinguishing effect with regard to the arc during its run is intensified.

The foregoing embodiments are to be regarded as merely illustrative, and various modifications and improvements may be resorted to, that fall within the scope of this invention

What is claimed is:

1. A circuit breaker comprising a pair of contactors comprising rigid conductors with contacts secured thereto, said contactors functioning to open and close an electric circuit, an arc shield disposed on at least one of said contactors, having a resistivity higher than that of said rigid conductors and which surrounds said contact, arc driving means to drive in a predetermined direction an electric arc struck across the gap between said pair of contactors, and an arc runway adjoining said contact provided with said arc shield, which extends in said predetermined direction with a predetermined height, said arc runway having a resistivity lower than that of said arc shield.

2. A circuit breaker as claimed in claim 1, wherein said arc shield is constructed as a flat plate and conceals said conductor therebehind.

3. A circuit breaker as claimed in claim 1, wherein said arc runway extends in said predetermined direction in a manner such that it is substantially level with the adjoining contact.

4. A circuit breaker as climed in claim 1, wherein said arc shield includes a slit which extends in said predetermined direction, and said arc runway is made of a metal strip which is disposed on said rigid conductor with said predetermined height in congruity with said slit, and which has a thermal conductivity higher than that of said rigid conductor.

5. A cirduit breaker as claimed in claim 1, wherein said arc shield includes a slit which extends in said predetermined direction, and said arc runway is made of a metal strip which is disposed on said rigid conductor with said predetermined height in congruity with said slit and which has a melting point higher than that of said rigid conductor.

6. A circuit breaker as claimed in claim 1, wherein said arc shield includes a slit which extends in said predetermined direction, and said arc runway is formed of a metal strip of a magnetic material which has the effect of deionizing an arc plasma, disposed on said rigid conductor with said predetermined height in congruity with said slit.

* * * * *